US005192738A

United States Patent [19]

Inagaki et al.

[11] Patent Number: 5,192,738

[45] Date of Patent: Mar. 9, 1993

[54] HEAT TRANSFER DYE-PROVIDING MATERIAL

[75] Inventors: Yoshio Inagaki; Seiiti Kubodera, both of Kanagawa, Japan

[73] Assignee: Fuji Photo Film Co., Ltd., Kanagawa, Japan

[21] Appl. No.: 787,609

[22] Filed: Nov. 4, 1991

[30] Foreign Application Priority Data

Nov. 5, 1990 [JP] Japan ..... 2-297165

[51] Int. Cl.[5] ..... B41M 5/035; B41M 5/38

[52] U.S. Cl. ..... 503/227; 428/195; 428/913; 428/914; 430/200; 430/201; 430/202; 430/945

[58] Field of Search ..... 8/471; 428/195, 480, 428/913, 914; 430/200, 201, 202, 945; 503/227

[56] References Cited

U.S. PATENT DOCUMENTS 4,948,778 8/1990 De Boer ..... 503/227

4,973,572 11/1990 De Boer ..... 503/227

*Primary Examiner*—B. Hamilton Hess

*Attorney, Agent, or Firm*—Sughrue, Mion, Zinn, Mackpeak & Seas

[57] ABSTRACT

There is disclosed a thermal transfer dye-providing material capable of providing a sharp image having a high density. The dye-providing material includes a support having provided thereon a layer containing a thermally migrating dye, wherein at least one of the dye-containing layer and a layer adjacent thereto contains an infrared-absorbing dye represented by Formula (I):

(I)

14 Claims, No Drawings

HEAT TRANSFER DYE-PROVIDING MATERIAL

FIELD OF THE INVENTION

The present invention relates to a dye-providing material used for heat transfer with an induced laser. More specifically, the present invention relates to a heat transfer dye providing material containing a specific infrared-absorbing dye.

In recent years, a heat transfer system has been developed for preparing a print from an image which has been electronically formed in a color video camera. In one method for preparing such a print, an electronic image is first subjected to color separation with a color filter. Next, the respective color-separated images are converted to electric signals. Subsequently, these signals are modulated to generate electric signals for yellow, magenta and cyan, and then these signals are transmitted to a thermal printer. In order to obtain the print, a dye-providing material of yellow, magenta or cyan is disposed on a dye image-receiving material face to face. Then, both are interposed between a thermal head and a platen roller and are heated from the backside of the dye-providing material with a line type thermal head. The thermal head has many heating elements, which are heated one by one in response to the yellow, magenta and cyan signals. Subsequently, this procedure is repeated for the other two colors. Thus, a color hard copy corresponding to the original image seen on a display can be obtained.

In another method of thermally obtaining a print with the electrical signals mentioned above, the thermal head can be replaced with a laser. In this system, the dye-providing material contains a substance capable of intensely absorbing laser light. The laser light is irradiated on the dye-providing material, and the absorptive substance converts the light energy to thermal energy; the energy is immediately transferred to the neighboring dyes, whereby the dyes are heated to a thermally immigrating temperature in order to transfer the dyes to the image-receiving material. The absorptive substance is present under the dye in a layer and/or is mixed with the dye. A laser beam is modulated with the electric signals corresponding to the shape and color of the original image, and only the dyes in the area necessary to be thermally immigrating in order to reconstruct the colors of the original image are heated for thermal transfer. More detailed explanations of the above process can be found in British Patent 2,083,726 A, in which the absorptive substance disclosed therein for the laser system is carbon.

The problem in using carbon as the absorptive substance lies in the fact that carbon comprises fine particles and that it is liable to flocculate in coating, which deteriorates the quality of the transferred image. Further, carbon is transferred to the image-receiving material by adhesion or abrasion, which causes speckles and insufficient color in the color image.

SUMMARY OF THE INVENTION

An object of the present invention is to provide an absorptive substance having no such defects.

The above and other objects can be achieved by a thermal transfer dye-providing material comprising a support having provided thereon a layer containing a thermally migrating dye, wherein at least one of the dye-containing layer and a layer adjacent thereto contains an infrared-absorbing dye represented by Formula (I):

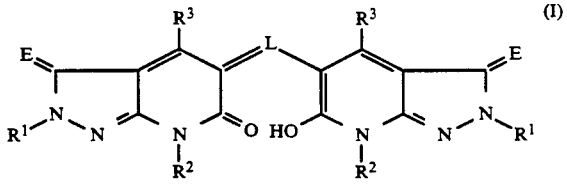

(I)

wherein L represents a substituted or unsubstituted methine group, trimethine chain or pentamethine chain, which is formed by linking the methine groups with a conjugated double bond; E represents O, S or N—$R^4$; $R^1$ and $R^4$ can be substituted or unsubstituted and independently represent an alkyl group, an alkenyl group, an alkynyl group, an aryl group, a heterocyclic group, an amino group, a hydrazino group, or a diazenyl group, provided that $R^1$ and $R^4$ may be combined to form a ring; $R^2$ can be substituted or unsubstituted and represents a hydrogen atom, an alkyl group, an aryl group, an alkenyl group, an alkynyl group, or a heterocyclic group; and $R^3$ can be substituted or unsubstituted and represents a hydrogen atom, a halogen atom, a cyano atom, a nitro group, a hydroxy group, a carboxyl group or a salt thereof, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group, or an alkynyl group.

DETAILED DESCRIPTION OF THE INVENTION

The compounds of Formula (I) can be present as the tautomeric mixture of the compounds of the following Formulas (Ia) and (Ib), but in the present invention, they are included in the compounds of Formula (I) for convenience.

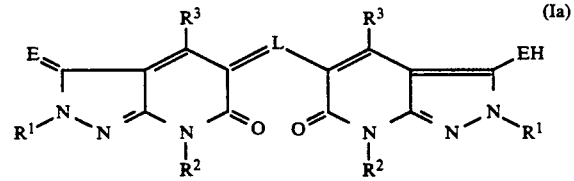

(Ia)

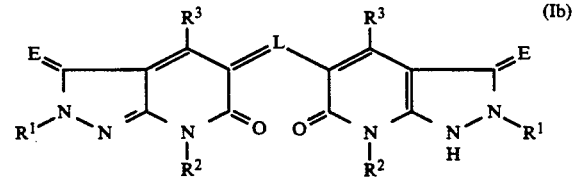

(Ib)

The compounds of Formula (1) will be explained below in detail.

In Formula (I), L represents a methine group or a methine chain which is formed by linking the methine groups with a conjugated double bond (e.g., a trimethine chain and a pentamethine chain). These linkage groups represented by L, such as a methine group and a trimethine chain, include those having substituents.

The methine chains represented by Formulas (a) to (i) are particularly preferred as the methine chain which is formed by linking the methine groups with a conjugate double bond.

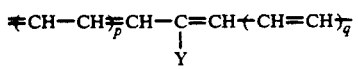

Formula (a)

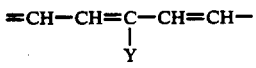

Formula (b)

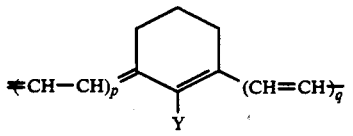

Formula (c)

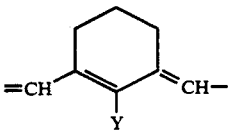

Formula (d)

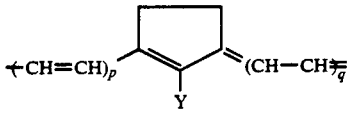

Formula (e)

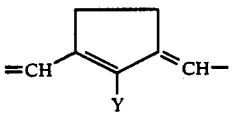

Formula (f)

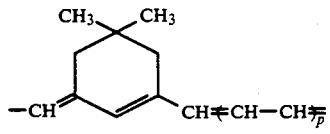

Formula (g)

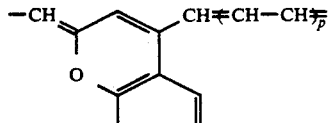

Formula (h)

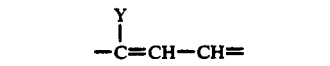

Formula (i)

In Formulas (a) to (i), Y represents a hydrogen atom or a monovalent group; and p and q independently represent 0 or 1. Preferred examples of the monovalent group include an alkyl group having from 1 to 8 carbon atoms (e.g., methyl), an aralkyl group, an alkoxy group having from 1 to 8 carbon atoms (e.g., methoxy), a disubstituted amino group (e.g., dimethylamino, diphenylamino, methylphenylamino, morpholino, imidazolidino, and ethoxycarbonylpiperazino), an alkylcarbonyloxy group (e.g., acetoxy), an alkylthio group (e.g., methylthio), a cyano group, a nitro group, and a halogen atom (e.g., F, Cl and Br).

Of the linkage groups represented by L, particularly preferred is the group represented by Formula (a) or (b), particularly the group in which Y is a hydrogen atom and at least one of p and q is 0.

The preferable substituents for L in Formula (I) are selected from the following groups, which may further be substituted: an alkyl group, an aralkyl group, an aryl group, a hydroxy group, a halogen atom (e.g., F, Cl, Br and I), a cyano group, a nitro group, an alkoxy group, an aralkyloxy group, an aryloxy group, an acyl group, an acyloxy group, an acylamino group, a sulfonamide group, an aryloxycarbonyl group, an aralkyloxycarbonyl group, an alkoxycarbonyl group, a carbamoyl group, a sulfamoyl group, a carboxy group or a carboxylate group, a sulfonic acid group or a sulfonate group, a carbamoylamino group, a sulfamoylamino group, an alkylsulfonyl group, an aralkylsulfonyl group, an arylsulfonyl group, an alkylsulfinyl group, an aralkylsulfinyl group, an arylsulfinyl group, an alkylthio group, an aralkylthio group, and an arylthio group. The carbon-containing substituents preferably have not more than 30 carbon atoms.

E represents O, S or N—$R^4$, and $R^1$ and $R^4$ independently represent an alkyl group, an alkenyl group, an alkynyl group, an aryl group, a heterocyclic group, an amino group, a hydrazino group, or a diazenyl group, each of which can be substituted.

Of the groups and elements represented by E, O or N—$R^4$ is preferred. An alkyl group, an alkenyl group, an aryl group, an amino group, a hydrazino group, or a diazenyl group is preferred as $R^4$. When E is N—$R^4$, the group in which $R^4$ is combined with $R^1$ to form a ring is preferred. The preferred examples of the ring formed by combining $R^1$ with $R^4$ include an imidazole ring, a pyrazole ring, a triazole ring, and a tetrazole ring, each of which may be substituted and may form a condensed ring with other rings.

Of the groups represented by $R^1$, an alkyl group having 1 to 30 carbon atoms, a substituted or unsubstituted phenyl group having 6 to 30 carbon atoms, and a substituted or unsubstituted 5- or 6-membered heterocyclic group having 1 to 30 carbon atoms (containing, for example, B, N, O, S, Se or Te as a hetero atom) are preferred. Examples of the heterocyclic group include a saturated heterocyclic ring such as a pyrolidyl group, a morpholino group, a 2-bora-1,3-dioxolanyl group, and a 1,3-thiazolidinyl group and an unsaturated heterocyclic group such as an imidazolyl group, a thiazolyl group, a benzothiazolyl group, a benzoxazolyl group, a benzotellurazolyl group, a benzoselenazolyl group, a pyridyl group, a pyrimidinyl group, a quinolinyl group, a triazinyl group, and an imidazolidinyl group.

Where the groups represented by $R^1$ and $R^4$ have substituents, preferred examples of the substituents are a halogen atom (e.g., F, Cl, Br and I), a cyano group, a nitro group, a carboxyl group and a salt thereof (e.g., the salts of Na, K and triethylamine), a sulfonic acid and a salt thereof (e.g., the salts of Na and K), a hydroxy group, an alkoxy group (e.g., methoxy, isopropoxy and hexadecyloxy), an aryloxy group (e.g., phenoxy, 2,5-di-t-pentylphenoxy, m-pentadecylphenoxy, pmethoxyphenoxy, 3,5'-dichlorophenoxy, 3-sulfophenoxy, and 3,5-disulfophenoxy), an alkyl group (e.g., methyl, 4-sulfobutyl, 2-methoxyethyl, and trifluoromethyl), an aryl group (e.g., phenyl, 4-sulfophenyl, 3-chlorophenyl, 4-hexylphenyl, and 2-naphthyl), a substituted or unsubstituted amino group (e.g., amino, methylamino, phenylamino, acetylamino, methanesulfonylamino, methylcarbamoylamino, phenylthiocarbamoylamino, and benzenesulfonylamino), a carbamoyl group (e.g., carbamoyl, methylcarbamoyl, phenylcarbamoyl, octadecylcarbamoyl, diethylcarbamoyl, and pyrrolidinocarbonyl), a sulfamoyl group (e.g., sulfamoyl, dimethylsulfamoyl, t-butylsulfamoyl, phenylsulfamoyl, pyrrolidinosulfonyl, and 4(2,4-di-t-pentylphenoxy) butylsulfamoyl), an alkyl- or arylthio group (e.g., methylthio, phenylthio, benzylthio, and octadecylthio), an alkylsulfonyl group (e.g. methanesulfonyl and 2-ethoxyethanesulfonyl), and an arylsulfonyl group (e.g., benzenesulfonyl, dodecylbenzenesulfonyl, and 2-(2-methoxyethoxy)-5-(4-hydroxyphenylazo)benzenesulfonyl).

Of the groups represented by $R^1$, an alkyl group having 1 to 20 carbon atoms, which may have the substituents defined for $R^1$ and $R^4$ as preferred substituents, a phenyl group having 6 to 20 carbon atoms, which may have the substituents defined for $R^1$ and $R^4$ as preferred substituents, and a 5- or 6-membered heterocyclic group having 1 to 20 carbon atoms (e.g., 2-pyridyl, 4-pyridyl, 2-benzothiazolyl, 2-(1-methylimidazolyl), and 4,6-diethylamino-2-triazinyl) are particularly preferred.

Examples of the alkyl group represented by $R^1$ are methyl, isopropyl, n-butyl, t-pentyl, cyclohexyl, 2-ethylhexyl, benzyl, 3-(2,4-di-t-pentylphenoxy) propyl, octadecyl, carboxymethyl, 4-sulfobutyl, 2-sulfobenzyl, 2-methoxyethyl, and trifluoromethyl. Examples of the phenyl group, including the substituted phenyl group, are phenyl, 4-methoxyphenyl, 3-chlorophenyl, 4-hexylphenyl, 3-sulfophenyl, 4-t-octylphenyl, 2-sulfophenyl, and 4-methanesulfonamide-2-sulfamoylphenyl. Examples of the heterocyclic group, including the substituted heterocyclic group, are 2-pyridyl, 2-imidazolyl, 1-methylbenzothiazole-2-yl, 2-imidazolidinyl, and 2pyrimidinyl.

$R^2$ represents a hydrogen atom, an alkyl group, an aryl group, an alkenyl group, an alkynyl group, or a heterocyclic group. The alkyl group, the aryl group, the alkenyl group, the alkynyl group, and the heterocyclic group can each be substituted.

Of the groups represented by $R^2$, a hydrogen atom, an alkyl group having 1 to 30 carbon atoms, a substituted or unsubstituted phenyl group having 6 to 30 carbon atoms, and a substituted or unsubstituted 5- or 6-membered heterocyclic group having 1 to 30 carbon atoms and containing a hetero atom selected from B, N, O, S, Se and Te are preferred. Where the groups represented by $R^2$ have substituents, preferred substituents are the groups defined for $R^1$ and $R^4$ as the preferred substituents.

Of the groups represented by $R^2$, a hydrogen atom, an alkyl group having 1 to 20 carbon atoms (e.g., methyl, 4-sulfobutyl, 2-methoxyethyl, trifluoromethyl, and benzoyloxymethyl), a phenyl group having 6 to 20 carbon atoms (e.g., phenyl, 4-sulfophenyl, 4-methoxyphenyl, 3-chlorophenyl, 3-trifluoromethylphenyl, 2-methanesulfonyl-4-nitrophenyl, 4-(N,N-dimethylsulfamoyl)phenyl, and 4-methanesulfonylphenyl), and a 5- or 6-membered heterocyclic group having 1 to 20 carbon atoms (e.g., 2-pyridyl, 4-pyridyl, 3-pyridyl, 2-benzothiazolyl, 2-(1-methylimidazolyl), and 4,6-dibutylamino2-triazinyl) are particularly preferred.

Examples of the alkyl group represented by $R^2$ are methyl, isopropyl, n-butyl, t-pentyl, cyclohexyl, 2-ethylhexyl, benzyl, 3-(2,4-di-t-pentylphenoxy) propyl, octadecyl, carboxymethyl, 2-methoxyethyl, and trifluoromethyl. Examples of the phenyl group, including the substituted phenyl group, are phenyl, 4-methoxyphenyl, 3-chlorophenyl, 4-hexylphenyl, 3-sulfophenyl, and 4-toctylphenyl.

$R^3$ represents a hydrogen atom, a halogen atom, a cyano group, a nitro group, a hydroxy group, a carboxyl group and a salt thereof, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group, or an alkynyl group, wherein the alkyl group, the aryl group, the alkenyl group, the heterocyclic group, the alkoxy group, the aryloxy group, the alkoxycarbonyl group, the aryloxycarbonyl group, the amino group, the acyloxy group, the carbamoyl group, the sulfamoyl group, the alkylthio group, the arylthio group, the alkylsulfonyl group, the arylsulfonyl group, and the alkynyl group can be substituted.

Of the groups represented by $R^3$, a hydrogen atom, an alkyl group having 1 to 30 carbon atoms, a phenyl group having 6 to 30 carbon atoms, a carbamoyl group having 1 to 30 carbon atoms, an alkoxycarbonyl group having 2 to 30 carbon atoms, a phenoxycarbonyl group having 7 to 30 carbon atoms, a carboxyl group and a salt thereof, and a hydroxy group are preferred. Where the groups represented by $R^3$ have substituents, preferred substituents are the groups defined for $R^1$ as the preferable substituents.

Of the groups represented by $R^3$, an alkyl group having 1 to 20 carbon atoms (e.g., methyl, t-butyl and trifluoromethyl), a phenyl group having 6 to 20 carbon atoms (e.g., phenyl, 4-methoxyphenyl, and 3,5-dichlorophenyl), a carbamoyl group having 1 to 20 carbon atoms (e.g., carbamoyl, methylcarbamoyl, diethylcarbamoyl, pyrrolidinocarbonyl, and 2-ethylhexylcarbamoyl), an alkoxycarbonyl group having 2 to 20 carbon atoms (e.g., ethoxycarbonyl, hexadecyloxycarbonyl, t-butoxycarbonyl, and cholesteryloxycarbonyl), a phenoxycarbonyl group having 7 to 20 carbon atoms (phenoxycarbonyl, 4-methylphenoxycarbonyl, 4-methoxyphenoxycarbonyl, and 3-chlorophenoxycarbonyl), a carboxyl group and a salt thereof (e.g., the salts of Na, K and triethylamine), and a hydroxy group are particularly preferred.

Preferred examples of the alkyl group, including the groups having substituents, are methyl, t-butyl, trifluoromethyl, 2-ethylhexyl, and pentadecyl. Preferred examples of the phenyl group, including the groups having substituents, are phenyl, 4-methoxyphenyl, and 4-nitrophenyl. Preferred examples of the carbamoyl group, including the groups having substituents, are carbamoyl, methylcarbamoyl, butylcarbamoyl, diethylcarbamoyl, pyrrolidinocarbonyl, morpholinocarbonyl, hexadecylcarbamoyl, phenylcarbamoyl, N-methyl-N-phenylcarbamoyl, 2-methoxyethoxycarbamoyl, and 2-ethylhexylcarbamoyl. Preferred examples of the alkoxycarbonyl group, including the groups having substituents, are ethoxycarbonyl, butoxycarbonyl, benzyloxycarbonyl, 2-methoxyethoxycarbonyl, and 2-dodecyloxyethoxycarbonyl.

The preceding infrared-absorbing dye may be used in any concentration, as long as it can provide the desired effect. In general, the dye can be used in the concentration of from about 0.04 to about 0.5 $g/m^2$ in a dye-providing layer itself or a layer adjacent thereto to obtain excellent results.

The spacer beads provided on the dye-providing layer may be used as a separating layer in order to separate satisfactorily the dye-providing material from the image-receiving material to thereby improve the uniformity of dye transferring and to increase the density of the transferred dye image.

Examples of infrared-absorbing dyes within the scope of the present invention are shown below, although these examples should not be construed as limiting the present invention in any way:
TABLE A
| Compound | $R^1$ | $R^2$ | $R^3$ | L | E |
|---|---|---|---|---|---|
| 1 | 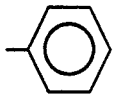 | $CH_3$ | $CH_3$ | $=CH(CH=CH)_2$ | O |
| 2 | " | 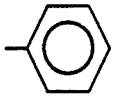 | " | " | O |
| 3 | " | 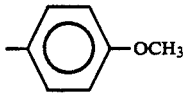 | " | " | O |
| 4 | " | 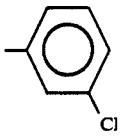 | " | " | O |
| 5 | " | 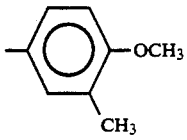 | " | " | O |
| 6 | " | 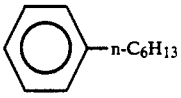 | " | " | O |
| 7 | 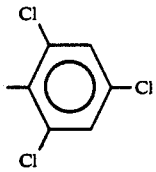 | 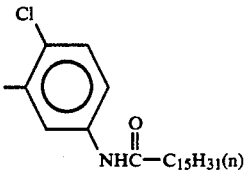 | " | " | O |
| 8 | 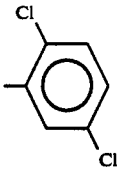 | $n\text{-}C_4H_9$ | 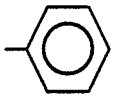 | " | O |
| 9 | 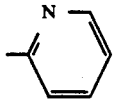 | $CH_3$ | $CH_3$ | " | O |
| 10 | 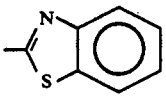 | 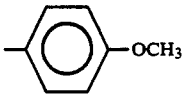 | " | " | O |
| 11 | $CH_3$ | $CH_3$ | " | " | O |
| 12 | $(CH_2)_4SO_3K$ | " | COOK | " | O |

TABLE A-continued

| Compound | $R^1$ | $R^2$ | $R^3$ | L | E |
|---|---|---|---|---|---|
| 13 | 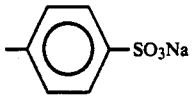 | 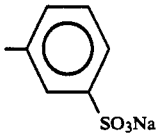 | COONa | " | O |
| 14 | 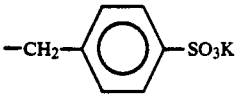 | 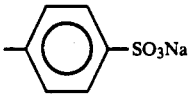 | $CH_3$ | $=CH\langle CH=CH\rangle_2$ | O |
| 15 | $\langle CH_2\rangle_4SO_3K$ | $\langle CH_2\rangle_4SO_3K$ | COOK | " | O |
| 16 | $\langle CH_2\rangle_4SO_3Na$ | $-CH_2CH_2OH$ | COONa | $=CH-CH=C(CH_3)-CH=CH-$ | O |
| 17 | 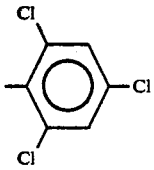 | $-CH_2CH(C_2H_5)-C_4H_9(n)$ | 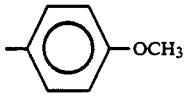 | $=CH\langle CH=CH\rangle_2$ | O |
| 18 | " | " | $-CONHC_3H_{17}(n)$ | " | O |
| 19 | $CH_3$ | $CH_3$ | H | 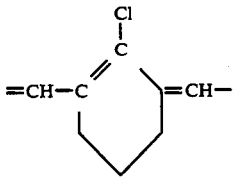 | O |
| 20 | 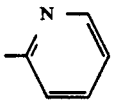 | 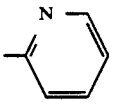 | $CH_3$ | $=CH\langle CH=CH\rangle_2$ | O |
| 21 | 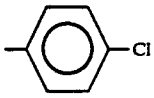 | $C_2H_5$ | 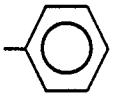 | 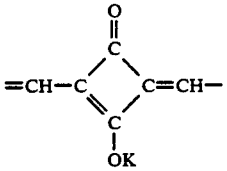 | O |
| 22 | 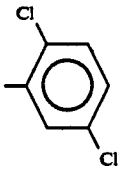 | $CH_3$ | $CH_3$ | 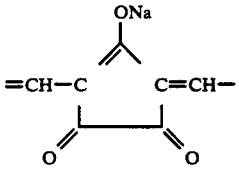 | O |
| 23 | 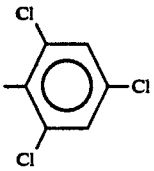 | 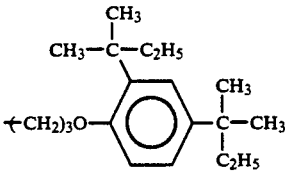 | $CH_3$ | $=CH\langle CH=CH\rangle_2$ | O |
| 24 | 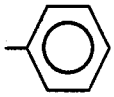 | $CH_3OCH_2CH_2-$ | $-SO_2CH_3$ | " | O |

TABLE A-continued
| Compound | $R^1$ | $R^2$ | $R^3$ | L | E |
|---|---|---|---|---|---|
| 25 | $CH_3$ | 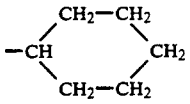 | $-NHC(=O)CH_3$ | $=CH(CH=CH)_2$ | O |
| 26 | 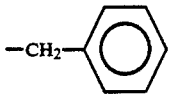 | 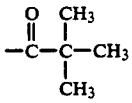 | 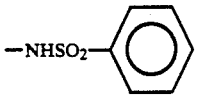 | " | O |
| 27 | $(CH_2)_4SO_3K$ | $CH_3$ | $-NHC(=O)NHCH_3$ | " | O |
| 28 | 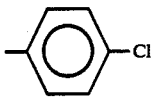 | 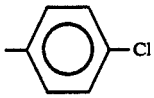 | 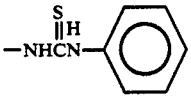 | " | O |
| 29 | 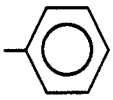 | $CH_3$ | $-OH$ | " | O |
| 30 | $(CH_2)_4SO_3K$ | $(CH_2)_4SO_3K$ | $-O-C(=O)CH_2CH_2C(=O)CH_3$ | " | O |
| 31 | 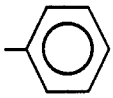 | $CH_3$ | $CH_3$ | $=CH-CH=CH-$ | O |
| 32 | 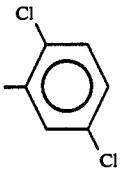 | $CH_3$ | $CH_3$ | $=CH-C(CH_3)=CH-$ | O |
| 33 | $(CH_2)_4SO_3K$ | $CH_3$ | COOK | $=CH-CH=CH-$ | O |
| 34 | 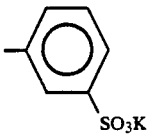 | 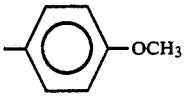 | COOK | $=CH-CH=CH-$ | O |
| 35 | " | " | " | $=CH-$ | O |
| 36 | 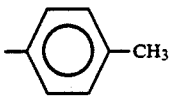 | 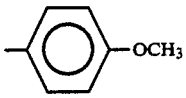 | $CH_3$ | $=CH-CH=CH-$ | O |
| 37 | 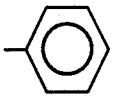 | 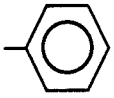 | $CH_3$ | $=CH-$ | O |
| 38 | 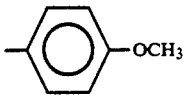 | $CH_3$ | 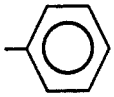 | 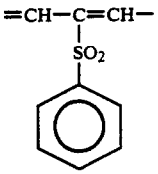 | O |

TABLE A-continued
| Compound | $R^1$ | $R^2$ | $R^3$ | L | E |
|---|---|---|---|---|---|
| 39 | 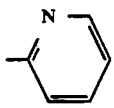 | " | $CH_3$ | =CH— | O |
| 40 | 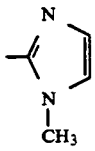 | 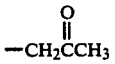 | " | 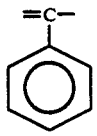 | O |
| 41 | 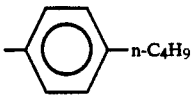 | 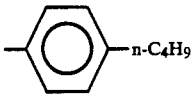 | 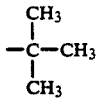 | $=CH\leftarrow CH=CH\rightarrow_2$ | O |
| 42 | 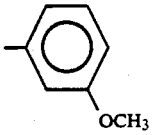 | 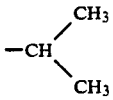 | 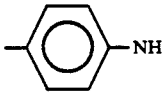 | 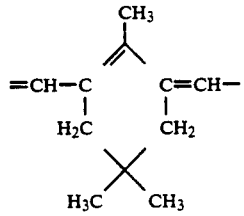 | O |
| 43 | 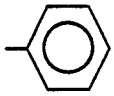 | $-CH_2C\equiv CH$ | $CH_3$ | $=CH\leftarrow CH=CH\rightarrow_2$ | O |
| 44 | 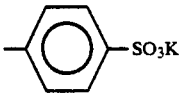 | $CH_3$ | " | =CH—CH=CH— | O |
| 45 | 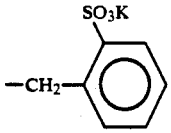 | 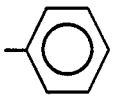 | " | " | O |
| 46 | $-CH_2CH_2SO_3K$ | $-COCH_3$ | COOK | " | O |
| 47 | 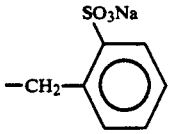 | $\leftarrow CH_2)_2SO_3Na$ | COONa | " | O |
| 48 | 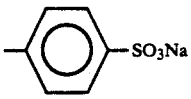 | 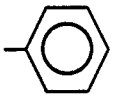 | COONa | " | O |
| 49 | 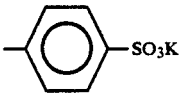 | $CH_3$ | COOK | =CH—CH=CH— | O |

TABLE A-continued
| Compound | $R^1$ | $R^2$ | $R^3$ | L | E |
|---|---|---|---|---|---|
| 50 | 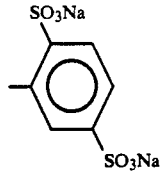 | " | COONa | " | O |
| 51 | 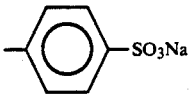 | 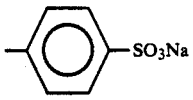 | $CH_3$ | " | O |
| 52 | " | $-CH_2CH_2OH$ | COONa | " | O |
| 53 | 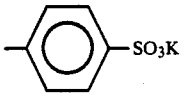 | $CH_3$ | $-CONHCH_2CH_2OH$ | " | O |
| 54 | $\leftarrow CH_2)_3SO_3K$ | $-CH_2CH_2COOK$ | 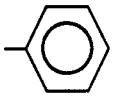 | " | O |
| 55 | 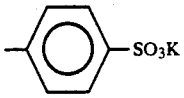 | $CH_3$ | $CH_3$ | $=CH-$ | O |
| 56 | 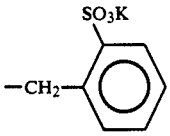 | 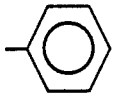 | COOK | " | O |
| 57 | $-CH_2CH_2SO_3K$ | " | $CH_3$ | $=CH-\overset{CH_3}{\overset{\vert}{C}}=CH-$ | O |
| 58 | 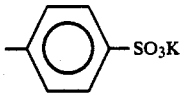 | $CH_3$ | COOK | $=CH\leftarrow CH=CH\rangle_2$ | O |
| 59 | " | 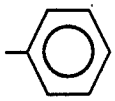 | $COOC_2H_5$ | $=CH-$ | O |
| 60 | " | " | $OC_2H_5$ | " | O |
| 61 | 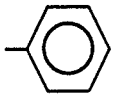 | H | $CH_3$ | $=CH\leftarrow CH=CH\rangle_2$ | O |
| 62 | 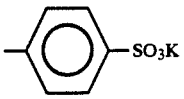 | " | " | " | O |

TABLE A-continued
| Compound | $R^1$ | $R^2$ | $R^3$ | L | E |
|---|---|---|---|---|---|
| 63 | 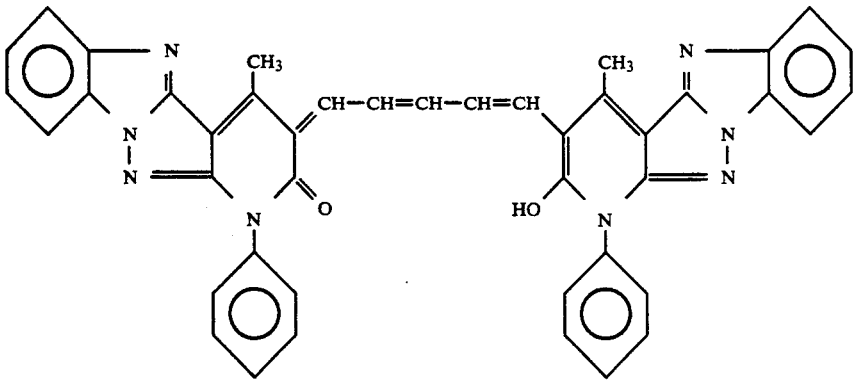 | | | | |
| 64 | 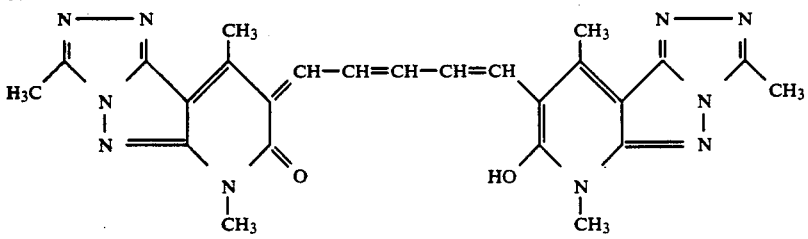 | | | | |
| 65 | 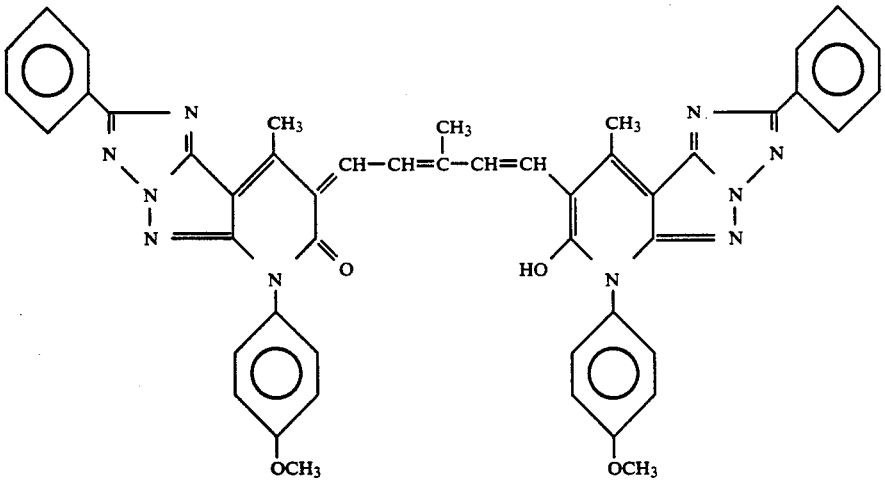 | | | | |
| 66 | 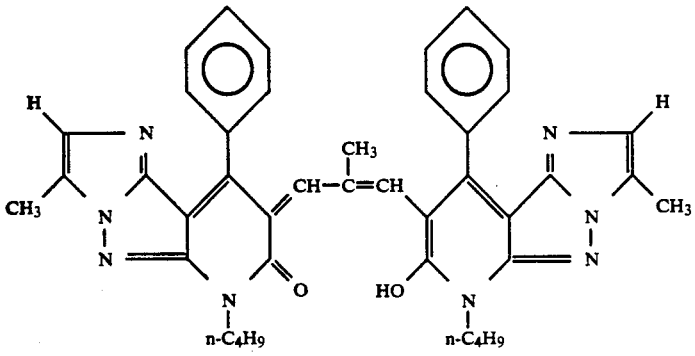 | | | | |

TABLE A-continued
| Compound | $R^1$ | $R^2$ | $R^3$ | L | E |
|---|---|---|---|---|---|
| 67 | 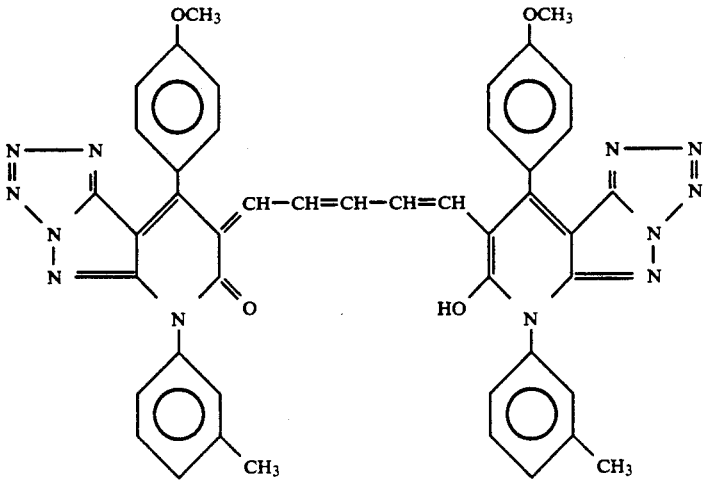 | | | | |
| 68 | 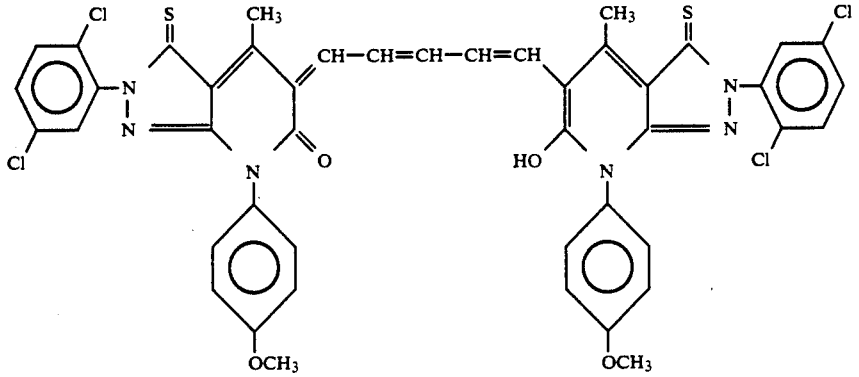 | | | | |
| 69 | 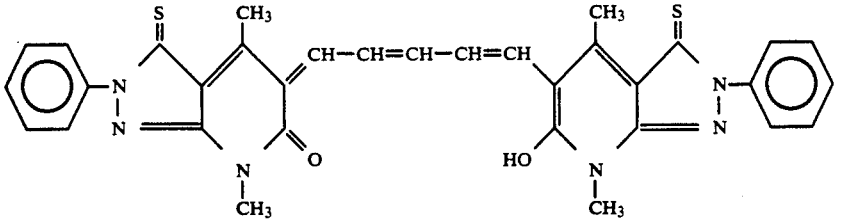 | | | | |
| 70 | 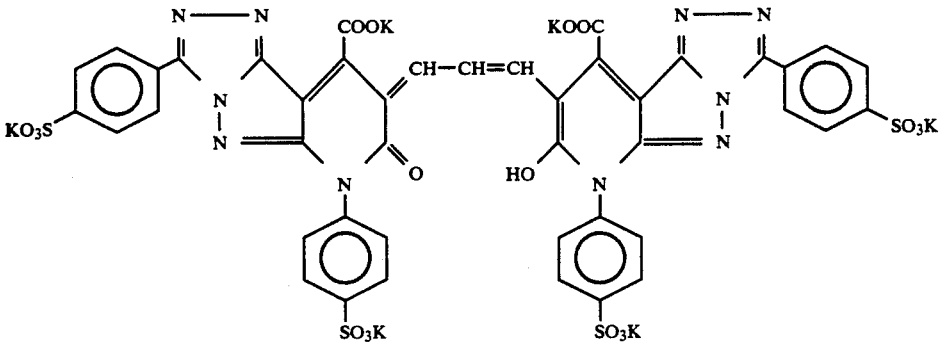 | | | | |

TABLE A-continued

| Compound | $R^1$ | $R^2$ | $R^3$ | L | E |
|---|---|---|---|---|---|
| 71 | 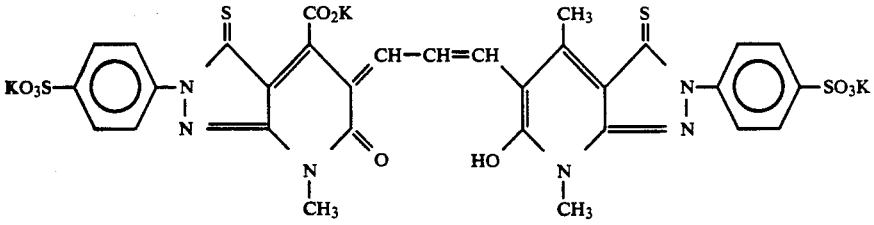 | | | | |
| 72 | 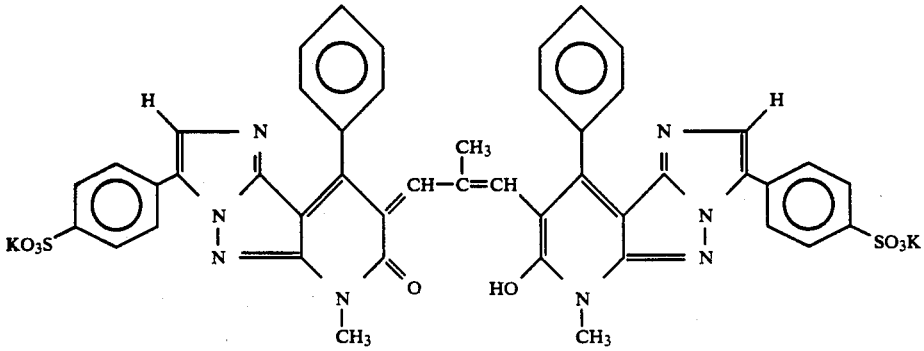 | | | | |

The compounds of the present invention can be synthesized by reacting the dioxopyrazolopyridine compound represented by the following Formula (II) in a suitable solvent such as methanol with compounds capable of providing the linkages of methine, trimethine and pentamethine (for example, ethyl ortho-formate, 1,5diphenyl-1,5-diaza-1,3-pentadiene, 1,5,5-trialkoxy 1,3-pentadiene, and 1,7-diphenyl-1,7-diaza-1,3,5-heptatriene). In the above synthesis, the reaction can sometimes be expedited by adding a basic compound such as triethylamine and an acid anhydride such as acetic acid anhydride. For more details, the above synthesis can be carried out by utilizing the methods described in JP-B-39-22069 (the term "JP-B" as used herein means an examined Japanese patent publication), JP-B-43-3504, JP-B-52-38056, JP-B-54-38129, and JP-B-55-10059, JP-A-49-99620 (the term "JP-A" as used herein means an unexamined published Japanese patent application) and JP-A-59-16834, and U.S. Pat. No. 4,181,225.

Formula (II)

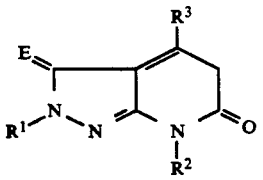

wherein $R^1$, $R^2$, $R^3$ and E each represent the same groups as those defined for $R^1$, $R^2$, $R^3$ and E, respectively, in Formula (I).

The compound represented by Formula (II) can be synthesized by heating the compound represented by Formula (III) and the compound represented by Formula (IV) under an acidic condition.

Formula (III)

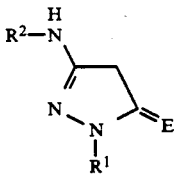

wherein $R^1$, $R^2$ and E each represent the same groups as those defined for $R^1$, $R^2$ and E, respectively, in Formula (I).

Formula (IV)

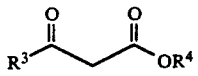

wherein $R^3$ represents the same group as that defined for $R^3$ in Formula (I), and $R^4$ represents an alkyl group or an aryl group.

The compound represented by Formula (II) can be synthesized as well by alkylating, arylating and acylating the dioxopyrazolopyridine compounds of the following Formula (V) described in JP-A-52-112626:

Formula (V)

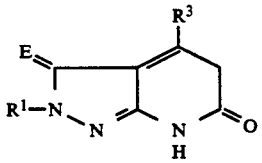

wherein $R^1$, $R^3$ and E each represent the same groups as those defined for $R^1$, $R^3$ and E, respectively, in Formula (I).

The functional groups on the compound represented by Formula (I) or (II) can be converted into other functional groups by the conventional methods.

Examples of the synthesis of compounds of the present invention are described below.

SYNTHESIS EXAMPLE 1

Synthesis of Compound 2

25 g of 1-phenyl-3-anilino-2-pyrazoline-5-one, 180 g of ethyl acetoacetate, and 150 ml of acetic acid were heated while refluxing for 6 hours. The reaction solution was diluted with water, and the solid formed was crystallized from acetonitrile to obtain 10.9 g of 2,7-diphenyl-4-methylpyrazolo[3,4-b]pyridine-3,6-dione. Melting point: 145° to 147° C.

A solution was prepared by adding 50 ml of methanol and 2.8 ml of triethylamine to 3.17 g of 2,7-diphenyl-4-methylpyrazolo[3, 4-b]pyridine-3,6-dione, and 2.85 g of 1,7-diphenyl-1,7-diaza-1,3,5-heptatriene hydrochloride was added to this solution, followed by the addition of 1.88 ml of anhydrous acetic acid and stirring at room temperature for 1 hour. The precipitate thus formed was filtered and washed with methanol, followed by drying, to obtain 1.9 g of 5-[5-(N-acetyl-anilino)-2, 3-pentadienylidene]-2,7-diphenyl-4-methylpyrazolo[3,4-b]pyridine-3,6-dione. 60 ml of N,N-dimethylformamide, 0.95 g of 2,7-diphenyl-4-methylpyrazolo[3,4-b]pyridine-3,6-dione and 0.42 ml of triethylamine were added to 1.5 g of this product, and the mixture was stirred at 50° C. for two hours. After filtering off a trace amount of the insoluble matter, ethyl acetate in an amount of ten times by volume was added to precipitate crystals while stirring. The obtained crystals were dissolved again in a small amount of N,N-dimethylformamide, and ethyl acetate in an amount of ten times by volume was added to precipitate crystals, followed by filtering and drying the crystals, whereby 1.3 g of Compound 2 were obtained. Golden crystal. Melting point: 300° C. or higher.

$\lambda_{max}^{DMF}$: 792 nm.

SYNTHESIS EXAMPLE 2

Synthesis of Compound 1

1.9 g of 3-methyl-1-phenyl-2-pyrazolin-5-one, 1.4 g of ethyl acetoacetate, and 8 ml of acetic acid were heated while refluxing for 6 hours. The reaction solution was diluted with water, and the precipitated crystals were filtered, followed by washing with isopropyl alcohol to obtain 1.8 g of 4,7-dimethyl-2-phenylpyrazolo[3,4-b]pyridine-3,6-dione (melting point: 179° to 181° C.). A solution was prepared by adding 20 ml of methanol and 0.7 ml of triethylamine to 1 g of the crystals obtained above, and 0.7 g of 1,7-diphenyl-1,7-diaza-1,3,5-heptatriene hydrochloride was added to this solution, followed by the addition of 0.6 ml of anhydrous acetic acid and stirring at room temperature for one hour. The precipitate thus formed was filtered and washed with methanol, followed by drying to obtain 0.2 g of 5-[5-(N-acetylanilino)-2,3-pentadienylidene]4, 7-dimethyl-2-phenylpyrazolo[3,4-b]pyridine-3,6-dione. 5 ml of N,N-dimethylformamide and 0.08 g of 4,7-dimethyl-2-phenylpyrazolo[3, 4-b]pyridine-3,6-dione were added to 0.15 g of this product, and the solution was stirred at 50° C. for 2 hours. After the reaction solution was filtered, it was diluted with water to precipitate crystals, followed by filtration, washing and drying to obtain 0.2 g of Compound 1. Melting point: 300° C. or higher.

$\lambda_{max}^{DMF}$: 760 nm.

SYNTHESIS EXAMPLE 3

Synthesis of Compound 4

To 5.7 g of 3-(3-chlorophenylamino)-1-phenyl-2-pyrazolin-5-one were added 2.8 g of ethyl acetoacetate and 40 ml of acetic acid and the mixture was heated while refluxing for 6 hours. The precipitated crystals were filtered and washed with isopropyl alcohol to obtain 2 g of 7-(3-chlorophenyl)-4-methyl-2-phenylpyrazolo[3, 4-b]pyridine-3,6-dione (melting point: 278° to 282° C.). A solution was prepared by adding 24 ml of methanol and 1.12 ml of triethylamine to 1.4 g of the crystals obtained above, 1.13 g of 1,7-diphenyl-1,7-diaza-1,3,5-heptatriene hydrochloride were added to this solution, and then 0.75 ml of anhydrous acetic acid was added with stirring at room temperature for one hour. The precipitate thus formed was filtered and washed with methanol, followed by drying to obtain 5-[5-(N-acetylanilino)-2, 3-pentadienylidene]-7-(3-chlorophenyl)-4-methyl-2-phenylpyrazolo[3, 4-b]pyridine-3,6-dione. 30 ml of N,N-dimethylformamide and 0.32 g of 8-(3-chlorophenyl)-4-methyl-2-phenylpyrazolo[3, 4-b]pyridine-3,6-dione were added to 0.5 g of this product, and the solution was stirred at 50° C. for 2 hours. After filtering the reaction solution, ethyl acetate in an amount of ten times by volume was added while stirring to precipitate crystals. The obtained crystals were dissolved again in a small amount of N,N-dimethylformamide, and then ethyl acetate in an amount of ten times by volume was added to precipitate crystals, followed by filtering, washing with ethyl acetate and drying to obtain 0.4 g of Compound 4. Melting point: 300° C. or higher.

$\lambda_{max}^{DMF}$: 792 nm.

SYNTHESIS EXAMPLE 4

Synthesis of Compound 3

To 14 g of 3-(4-methoxyphenylamino)-1-phenyl-2-pyrazoline-5-one were added 8.5 g of ethyl acetoacetate and 75 ml of acetic acid, and the mixture was heated while refluxing for 6 hours. The reaction solution was poured into 150 ml of water, and the solid formed was dissolved by heating in a mixture of 500 ml of methanol and 150 ml of acetone, followed by cooling to obtain 8.4 g of 7-(4-methoxyphenyl)-4-methyl-2-phenylpyrazolo[3,4b]pyridine-3, 6-dione (melting point: 189° to 190° C.). A solution was prepared by adding 40 ml of methanol and 2.8 ml of triethylamine to 3.47 g of the crystals obtained above, 2.85 g of 1,7-diphenyl-1,7-diaza-1,3,5-heptatriene hydrochloride was added to this solution, and then 1.88 ml of anhydrous acetic acid was added with stirring at room temperature for one .hour. The precipitate thus formed was filtered and washed with methanol, followed by drying to obtain 4.1 g of 5-[5-(N-acetylanilino)-2, 3-pentadienylidene]-7-(4-methoxyphenyl)-4-methyl-2phenylpyrrazolo[3, 4-b]pyridine-3,6-dione. 40 ml of N,N-dimethylformamide, 2.5 g of 7-(4-methoxyphenyl)-4-methyl-2-phenylpyrazolo[3, 4-b]pyridine-3, 6-dione and 0.98 ml of triethylamine were added to 3.8 g of this product, and the solution was stirred at 50° C. for 2 hours. After the reaction solution was filtered, ethyl acetate in an amount of ten times by volume was added while stirring to precipitate crystals. The obtained crystals were recrystallized with acetonitrile to obtain 1.0 g of Compound 3 was obtained.

Melting point: 260° C. (decomposed).

$\lambda_{max}^{DMF}$: 762 nm.

SYNTHESIS EXAMPLE 5

Synthesis of Compound 5

Compound 5 was prepared in the same manner as Synthesis Example 1, except that 1-phenyl-3-anilino-2-pyrazolin-5-one was replaced by 3-(3-methyl-4-methoxyphenylamino)-1-phenyl-2-pyrazolin-5-one. Melting point: 300° C. or higher.

SYNTHESIS EXAMPLE 6

Synthesis of Compound 6

Compound 6 was prepared in the same manner as Synthesis Example 1, except that 1-phenyl-3-anilino-2-pyrazolin-5-one was replaced by 3-(4-n-hexylphenylamino)-1-phenyl-2-pyrazolin-5-one. Melting point: 220° to 223° C.

Compounds 12 to 16, 27, 30, 33 to 35 and 44 to 60 were prepared in the same manner as described above for Synthesis Example 1. The melting points thereof were all 300° C. or higher.

Conventional materials can be used for the support of the heat transfer dye-providing material of the present invention. Examples thereof are polyethylene terephthalate, polyamide, polycarbonate, glassine paper, condenser paper, cellulose ester, fluorinated polymer, polyether, polyacetal, polyolefin, polyimide, polyphenylene sulfide, polypropylene, polysulfone, and cellophane.

The thickness of the support for the heat transfer dye-providing material is generally 2 to 30 μm. A subbing layer may be provided if necessary.

The heat transfer dye-providing material containing a thermally immigrating dye basically comprises a support having provided thereon a dye-providing layer containing a dye which becomes mobile by heating and a binder. This heat transfer dye-providing material can be prepared by applying a coating solution on one side of a conventional support for the heat transfer dye-providing material in an amount which gives a dry thickness of, for example, about 0.2 to 5 μm, preferably 0.4 to 2 μm, to thereby form a dye-providing layer, wherein the coating solution is prepared by dissolving or dispersing a conventional dye which sublimes or becomes mobile by heating and a binder in an appropriate solvent.

The solvents for dissolving or dispersing the above-described dye and binder can be conventional ink solvents, and examples of such solvents include an alcohol such as methanol, ethanol, isopropyl alcohol, nbutanol and isobutanol, a ketone such as methyl ethyl ketone, methyl isobutyl ketone and cyclohexanone, an aromatic solvent such as toluene and xylene, a halogenated hydrocarbon such as dichloromethane, and trichloroethane, dioxane, tetrahydrofuran and the like, and a mixture thereof.

The dye-providing layer may be a single layer structure, or it may have a structure of two or more layers so that the heat transfer dye-providing material can be applied many times, wherein the respective layers may have the different dye contents and dye/binder ratios.

Any dyes which are conventionally used for a heat transfer dye-providing material can be used as the dye useful for forming such a dye-providing layer. Of them, dyes having a molecular weight as small as about 150 to 800 are particularly preferred in the present invention, and the dyes are selected in view of transfer temperature, hue, light fastness, dissolving property and dispersibility in an ink and a binder.

Examples thereof are a dispersion dye, a basic dye and an oil-soluble dye. Of them, Sumikaron Yellow E4GL, Dianics Yellow H2G-FS, Miketon Polyester Yellow 3GSL, Kayaset Yellow 937, Sumikaron Red EFBL, Dianics Red ACE, Miketon Polyester Red FB, Kayaset Red 126, Miketon First Brilliant Blue B, and Kayaset Blue 136 are preferably used.

Further, the yellow dye represented by the following Formula (Y) is preferably used:

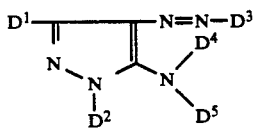

(Y)

wherein $D^1$ represents a hydrogen atom, an alkyl group, an alkoxy group, an aryl group, an alkoxycarbonyl group, a cyano group, or a carbamoyl group; $D^2$ represents a hydrogen atom, an alkyl group, or an aryl group; $D^3$ represents an aryl group or a heteroaryl group; $D^4$ and $D^5$ each represent a hydrogen atom or an alkyl group; and each of the above groups may be substituted.

Examples of the yellow dye are shown below:

Y-1

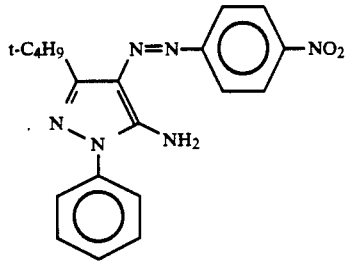

Y-2

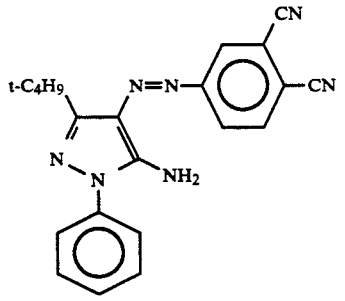

Y-3

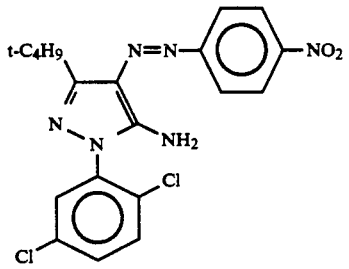

-continued

Y-4

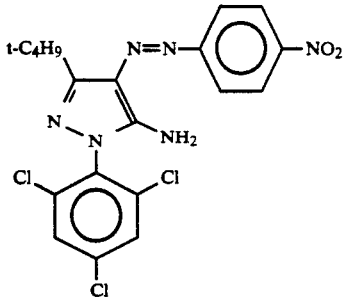

Y-5

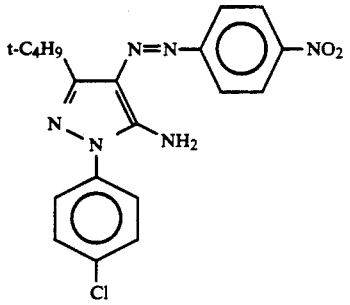

Y-6

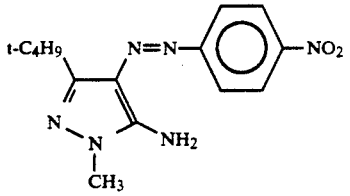

Y-7

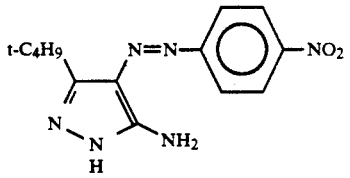

Y-8

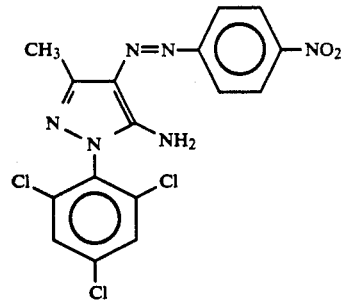

Y-9

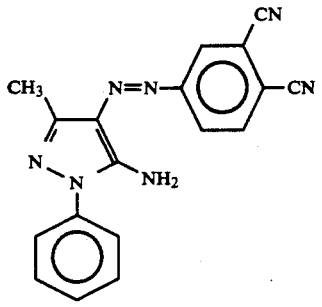

-continued

Y-10

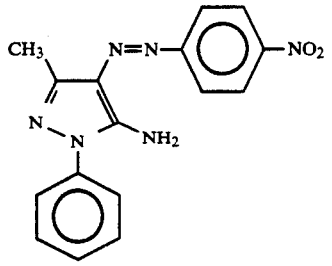

Y-11

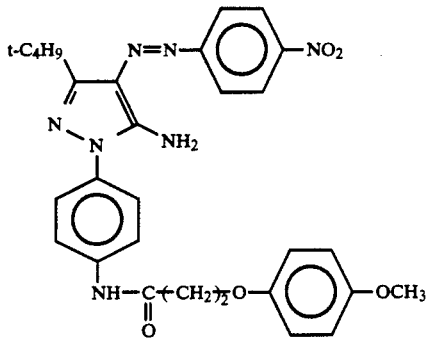

The dye represented by the following Formula (M) is preferred as a magenta dye:

(M)

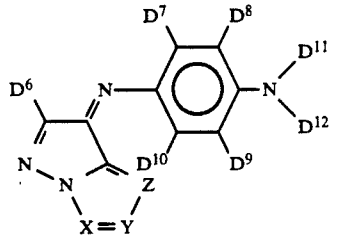

wherein $D^6$ to $D^{10}$ each represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^{11}$ and $D^{12}$ each represent a hydrogen atom, an alkyl group, or an aryl group, provided that $D^{11}$ and $D^{12}$ may be combined with each other form a ring and that $D^8$ and $D^{11}$ and/or $D^9$ and $D^{12}$ may be combined with each other to form a ring; X, Y and Z each represent a nitrogen atom and $$=\overset{\overset{D^{13}}{|}}{C}-,$$

in which $D^{13}$ represents a hydrogen atom, an alkyl group, an aryl group, an alkoxy group, an aryloxy group, or an amino group, provided that when X and Y or Y and Z are $$=\overset{\overset{D^{13}}{|}}{C}-,$$

the two $D^{13}$s may be combined with each other to form a saturated or unsaturated carbon ring; and each of the above groups may be substituted.
Examples of the magenta dye are shown below:
M-1
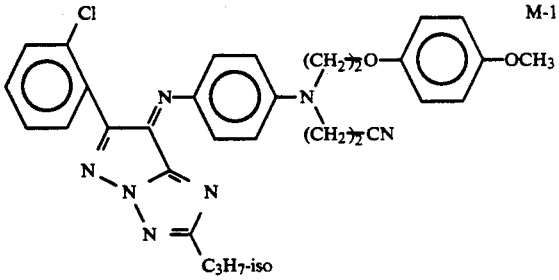
M-2
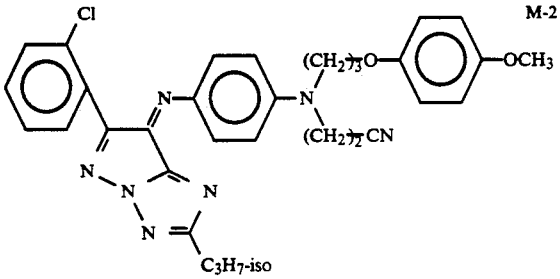
M-3
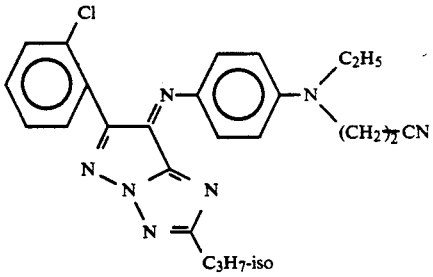
M-4
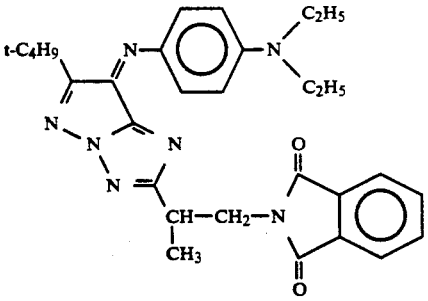
M-5
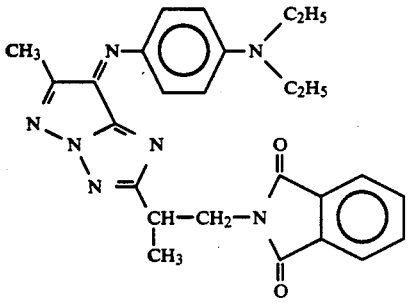
-continued
M-6
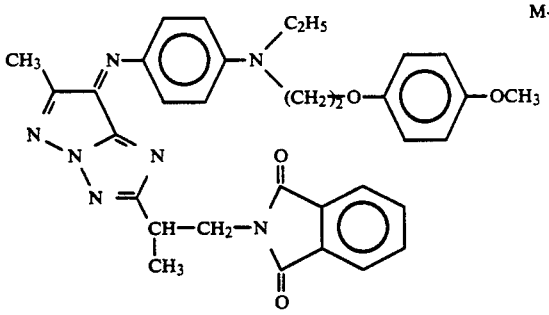
M-7
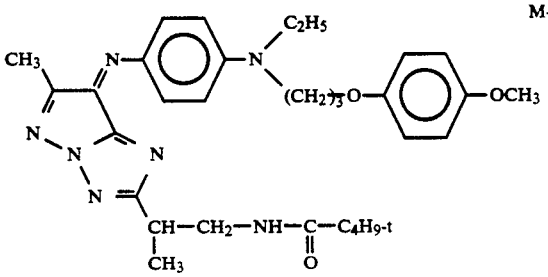
M-8
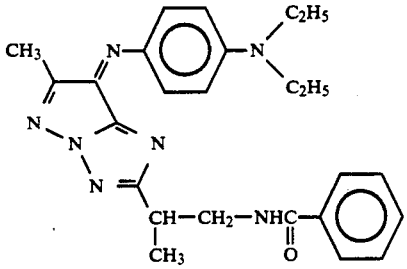
M-9
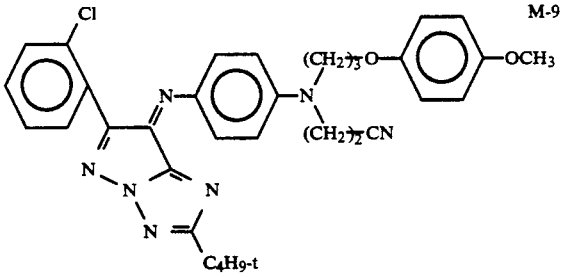
M-10
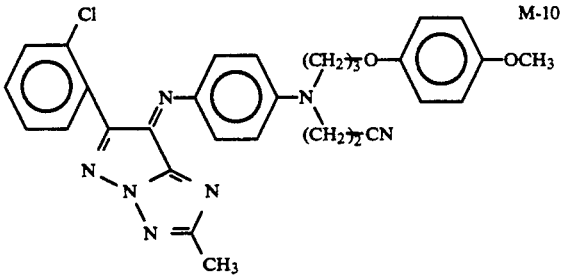
The dye represented by the following Formula (C) is preferable as a cyan dye:

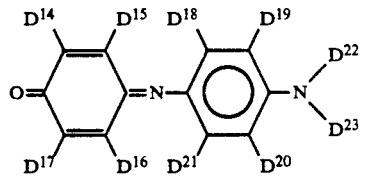

(C)

wherein $D^{14}$ to $D^{21}$ each represent the same groups as those defined above for $D^{6}$ to $D^{10}$; and $D^{22}$ and $D^{23}$ each represent the same groups as those defined above for $D^{11}$ and $D^{12}$.

Examples of the cyan dye are shown below:

C-1

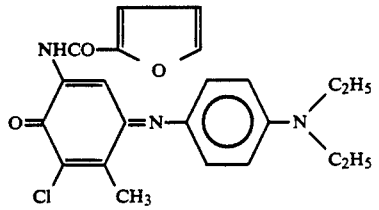

C-2

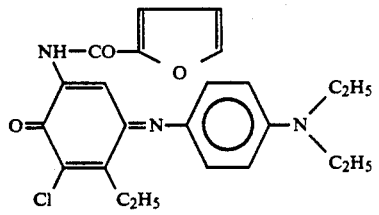

C-3

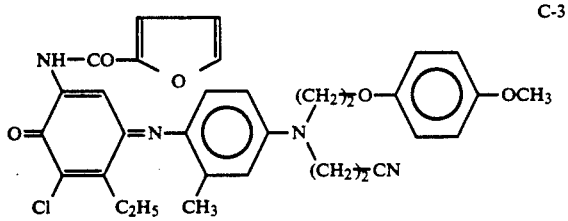

C-4

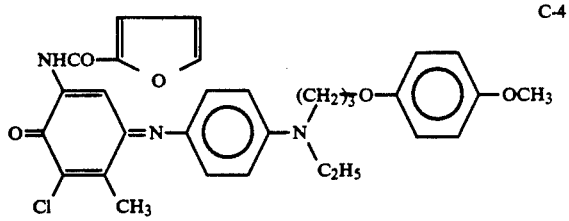

C-5

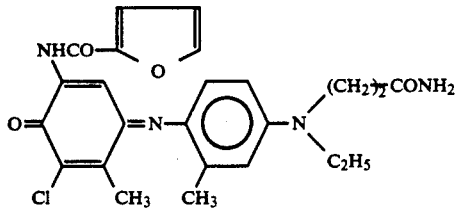

-continued

C-6

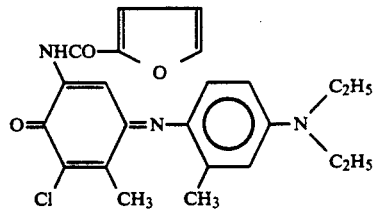

C-7

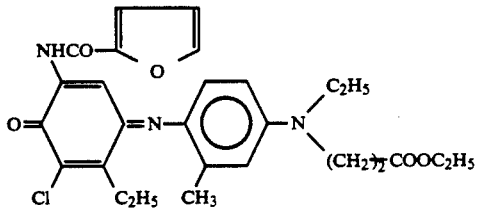

C-8

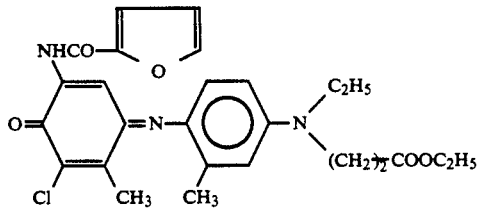

C-9

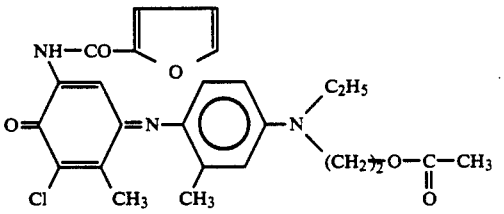

The compounds in which an anti-fading group described in Japanese Patent Application No. 1-271078 is introduced into the compounds represented by above Formulas (Y), (M) and (G) are preferable because light fastness can be improved.

Any conventional binder resins known to be useful for such purpose as that of the present invention can be used in combination with the above dyes. Usually, the binder resins which have a high thermal resistance and in addition do not prevent the dyes from transferring during heating are selected. Examples of the resins used in the present invention are a polyamide resin, a polyester resin, an epoxy resin, a polyurethane resin, a polyacrylic resin (for example, polymethyl methacrylate, polyacrylamide, and polystyrene-2-acrylonitrile), a vinyl resin including polyvinylpyrrolidone, a polyvinylchloride resin (for example, a copolymer of vinylchloride-vinyl acetate), a polycarbonate resin, polystyrene, polyphenylene oxide, a cellulose resin (for example, methylcellulose, ethylcellulose, carboxymethylcellulose, cellulose acetate biphthalate, cellulose acetate, cellulose acetate propionate, cellulose acetate butylate, and cellulose triacetate), a polyvinyl alcohol resin (for example, polyvinyl alcohol and a partially saponified polyvinyl alcohol such as polyvinyl butyral), a petroleum resin, a rosin derivative, a cumarone-indene resin, a terpene resin, and a polyolefin resin (for example, polyethylene and polypropylene).

These binders are used preferably in a ratio of from about 80 to about 600 parts by weight per 100 parts by weight of a dye.

In the present invention, the above-described conventional ink solvents can be arbitrarily used as the ink solvent for dissolving or dispersing the above dyes.

The dye-providing material may be provided with a hydrophilic dye-barrier layer in order to prevent the dyes from diffusing toward the support. The hydrophilic dye-barrier layer contains a hydrophilic compound useful for the intended purpose. In general, excellent results can be obtained with gelatin, polyacrylamide, polyisopropylacrylamide, butyl methacrylate-grafted gelatin, ethyl methacrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, and a mixture of cellulose monoacetate and polyacrylic acid. Of these hydrophilic compounds, polyacrylic acid, cellulose monoacetate and polyvinyl alcohol are particularly preferred.

The dye-providing material may be provided with a subbing layer. In the present invention, any material can be used for the subbing layer as long as it can provide the desired effect. Preferred examples thereof are a copolymer of acrylonitrile, vinylidene chloride and acrylic acid (14:80:6 by weight), a copolymer of butyl acrylate, 2-aminoethyl methacrylate and 2-hydroxyethyl methacrylate (30:20:50 by weight), a linear, saturated polyester (for example, Bostic 7650 manufactured by Emhart Co., Bostic Chemical Group), and a chlorinated high-density polyethylenetrichloroethylene resin. The coated amount of the subbing layer is not specifically limited. Usually it is from about 0.1 to about 2.0 $g/m^2$.

In the dye-providing layer, the dye is selected so that the transfer can be carried out at a desired hue in printing, and if necessary, two or more dye-providing layers, each containing a different dye, may be formed in order on the heat transfer dye-providing material. For example, where printing of each color is repeated according to the signals of the separated colors to form an image like a color photo, the hue of a printed image comprises preferably cyan, magenta and yellow, and three dye-providing layers containing the dyes capable of giving such hue are provided. Alternatively, in addition to cyan, magenta and yellow, a dye-providing layer containing a dye capable of giving a black hue may be added. It is preferred to provide the dye-providing material with a mark for detecting a position. The mark is preferably formed by multi-color gravure printing simultaneously with the formation of the dye-providing layers on the supports. The mark can be any material as long as it can be detected by an electric, magnetic or optical means as disclosed in JP-A-1-202491.

In the present invention, any support can be used for the heat transfer image-receiving material as long as it can endure a transfer temperature and satisfy the requirements of smoothness, whiteness, sliding property, frictional property, antistatic property, and dimpling after transferring. Examples thereof are a paper support such as a synthetic paper (e.g., synthetic papers of polyolefin and polystyrene), a woodfree paper, an art paper, a coat paper, a cast-coated paper, a wall paper, a backing paper, a synthetic resin or emulsionimpregnated paper, a synthetic rubber latex-impregnated paper, a synthetic resin-lining paper, a board paper, a cellulose fiber paper, and a polyolefin-coated paper (in particular, a paper coated on both sides with polyethylene); various plastic films or sheets of polyolefin, polyvinyl chloride, polyethylene terephthalate, polystyrene, polymethacrylate, and polycarbonate, and films or sheets thereof each subjected to the processing for providing a white color reflectiveness; and laminated materials comprising combination of the above materials.

The heat transfer image-receiving material is provided with an image-receiving layer. This image-receiving layer is preferably a layer containing singly or in combination with the other binders a substance capable of receiving a thermally immigrating dye transferring from the heat transfer dye-providing material during printing and having a function of fixing the dye therein. The thickness thereof is preferably on the order of from about 0.5 to about 50 μm.

Examples of polymers which are typical substances capable of receiving the thermally immigrating dyes are as follows:

(1) Polymers having an ester bond:

A polyester resin obtained by condensing a dicarboxylic acid component such as terephthalic acid, isophthalic acid or succinic acid (these dicarboxylic acid components may be substituted with a sulfonic acid group or a carboxylic acid group) with ethylene glycol, diethylene glycol, propylene glycol, neopentyl glycol or bisphenol A; a polyacrylate resin and a polymethacrylate resin such as polymethyl methacrylate, polybutyl methacrylate, polymethyl acrylate or polybutyl acrylate; a polycarbonate resin; a polyvinyl acetate resin; a styrene-acrylate resin; and a vinyltoluene-acrylate resin. Examples thereof are described in more detail in JP-A-59-101395, JP-A-63-7971, JP-A-63-7972, JP-A-63-7973, and JP-A-60-294862. Commercially available products include Vylon 290, Vylon 200, Vylon 280, Vylon 300, Vylon 103, Vylon GK-140, and Vylon GK-130, each manufactured by Toyobo Co., and ATR-2009 and ATR-2010, each manufactured by Kao Corporation.

(2) Polymers having a urethane bond, such as a polyurethane resin.

(3) Polymers having an amide bond, such as a polyamide resin.

(4) Polymers having a urea bond, such as a urea resin.

(5) Polymers having a sulfone bond, such as a polysulfone resin.

(6) Other polymers having a high-polar bond, such as a polycaprolactone resin, a styrene-maleic anhydride resin, a polyvinyl chloride resin, and a polyacrylonitrile resin.

In addition to the above synthetic resins, mixtures of these polymers or copolymers thereof can be used as well.

A high boiling solvent or a hot-melt solvent which can be used as the substance capable of receiving the thermally immigrating dye or as a dispersion aid can be incorporated into the heat transfer image-receiving material, particularly into the image-receiving layer.

Examples of the high boiling solvent and hot-melt solvent ar the compounds described in JP A-62-174754, JP-A-62-245253, JP-A-61-209444, JP-A-61-200538, JP-A-62-8145, JP-A-62-9348, JP-A-62-30247, and JP-A-62-136646.

In the present invention, the image-receiving layer of the heat transfer image-receiving material may be of a structure in which the substance capable of receiving the thermally immigrating dye dispersed in a water soluble binder is applied. The water soluble binders used in this case may be various conventional polymers. The water soluble polymers having a group capable of undergoing a crosslinking reaction with a hardener are preferable. Of these water soluble polymers, gelatins are particularly preferable.

The image-receiving layer may be composed of two or more layers, wherein the layer closer to the support is preferably of the structure in which a synthetic resin having a lower glass transition point, a high-boiling solvent and a hot-melt solvent are used to increase the dyeing property; and the outermost layer is preferably of the structure in which a synthetic resin having a higher glass transition point, a high-boiling solvent and a hot-melt solvent are used in a necessary minimum amount or not at all to prevent problems such as adhesiveness on a surface, sticking to the other materials, retransfer to the other materials after transfer, and blocking with the heat transfer dye-providing material.

The total thickness of the image-receiving layer preferably about 0.5 to 50 μm, particularly 3 to 30 μm. Where the image-receiving layer is of the two layer structure, the thickness of the outermost layer is preferably about 0.1 to 2 μm, particularly 0.2 to 1 μm.

In the present invention, the heat transfer image-receiving material may be provided with an intermediate layer between the support and an image-receiving layer.

The intermediate layer functions as at least one of a cushion layer, a porous layer and a dye diffusion-preventing layer, and in certain occasions, it also functions as an adhesive.

The dye diffusion-preventing layer has the function, in particular, of preventing the thermally immigrating dye from diffusing to the support. The binder constituting this diffusion-preventing layer may be either water-soluble or organic solvent-soluble. A water soluble binder is preferable, and examples thereof are the same ones as those defined for the binders for the image-receiving layer. Of these water soluble binders, gelatin is particularly preferable.

The porous layer has the function of preventing the heat applied in heat transfer from diffusing to the support in order to efficiently utilize the applied heat.

In the present invention, an image-receiving layer, a cushion layer, a porous layer, a diffusion-preventing layer and an adhesive layer each constituting the heat transfer image-receiving material may contain fine powders such as silica, clay, talc, diatomaceous earth, calcium carbonate, calcium sulfate, barium sulfate, aluminium silicate, synthetic zeolite, zinc oxide, lithopone, titanium oxide, and alumina.

A fluorescent whitening agent may be used for the heat transfer image-receiving material. Examples thereof are the compounds described in "The Chemistry of Synthetic Dyes" edited by K. Veenkataraman, Vol. 5, Chapter 8, and JP-A-61-143752. Specific examples are a stilbene compound, a coumarin compound, a biphenyl compound, a benzoxazolyl compound, a naphthalimide compound, a pyrazoline compound, a carbostyryl compound, and 2,5-dibenzoxazolthiophene compound.

A fluorescent whitening agent can be used in combination with an anti-fading agent.

In the present invention, in order to improve the releasing properties of the heat transfer dye-providing material and the heat transfer image-receiving material, a releasing agent is incorporated preferably into the layers constituting the dye-providing material and/or the image-receiving material, particularly preferably into the outermost layers on which both materials are contacted.

As the releasing agent, any of the conventional releasing agents, such as solid or wax substances including fine powders of polyethylene wax amide wax and a silicon resin, and a fine powder of a fluorinated resin; fluorine type and phosphate type surfactants; and paraffin type, silicone type and fluorine type oils, can be used. Of these releasing agents, a silicone oil is particularly preferred.

As a silicone oil, the modified silicone oils of a carboxy modification, an amino modification, an epoxy modification, a polyether modification, and an alkyl modification, in addition to the non-modified ones, can be used. They can be used singly or in combination with each other. Examples thereof are various modified silicone oils described on pages 6 to 18B of the technical document "Modified Silicone Oil", published by Shin-Etsu Chemical Co., Ltd. Where they are used in an organic solvent type binder, an amino-modified silicone having a group capable of reacting with a crosslinking agent of this binder (for example, a group capable of reacting with isocyanate) is effective; and where they are used by being emulsified and dispersed in a water-soluble binder, a carboxy-modified silicone oil (for example, the brand X-22-3710, manufactured by Shin-Etsu Chemical Co., Ltd.) or an epoxy-modified silicone oil (for example, the brand XF-100T, manufactured by Shin-Etsu Chemical Co., Ltd.) is effective.

The layers constituting the heat transfer dye-providing material and the heat transfer image-receiving material used in the present invention may be hardened with a hardener.

Where an organic solvent type polymer is hardened, the hardeners described in JP-A-61-199997 and JP-A-58-215398 can be used. In particular, an isocyanate type hardener is preferably used for a polyester resin.

In hardening a water-soluble polymer, the hardeners described in column 41 of U.S. Pat. No. 4,678,739, and in JP-A-59-116655, JP-A-62-245261 and JP-A-61 18942 can be used. Specific examples thereof are an aldehyde type hardener (e.g., formaldehyde), an aziridine type hardener, an epoxy type hardener

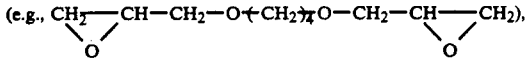

a vinylsulfone type hardener (e.g., N,N'-ethylene-bis(-vinylsulfonylacetoamide) ethane), an N-methylol type hardener (e.g., dimethylol urea), and a polymer hardener (e.g., the compounds described in JP-A-62-234157).

An anti-fading agent may be used for the heat transfer dye-providing material and the heat transfer image-receiving material. Examples of the anti-fading agent are an anti-oxidation agent, a UV absorber and a metal complex.

Examples of the anti-oxidation agent are a chroman type compound, a coumaran type compound, a phenol type compound (e.g., hindered phenols), a hydroquinone derivative, a hindered amine derivative, and a spiroindane type compound. Further, the compounds described in JP-A-61-159644 are effective as well.

Examples of the UV absorber are a benzotriazole type compound (U.S. Pat. No. 3,533,794), a 4-thiazolidone type compound (U.S. Pat. No. 3,352,681), a benzophenone type compound (JP-A-56-2784), and compounds described in JP-A-54-48535, JP-A-62-136641 and JP-A-61-88256. Also, a UV absorptive polymer described in JP-A-62-260152 is effective.

Examples of the metal complex are the compounds described in U.S. Pat. Nos. 4,241,155, 4,245,018 (columns 3 to 36), and 4,254,195 (columns 3 to 8), and JP-A-62-174741, JP-A-61-88256 (pages 27 to 29), JP-A-1-75568, and JP-A-63-199248.

Examples of a useful anti-fading agent are described in JP-A-62-215272 (pages 125 to 137). The anti-fading agent used for preventing a dye transferred to an image-receiving material from fading may be incorporated in advance into the image-receiving material or may be supplied to the image-receiving material from the outside by a method such as transferring the anti-fading agent from the dye-providing material.

The above anti-oxidation agent, UV absorber and metal complex may be used in combination with each other.

Various surfactants can be used in the component layers of the heat transfer dye-providing material and the heat transfer image-receiving material as coating aids and for improving peeling and sliding properties, antistatic property and the promotion of development.

Also, a nonionic surfactant, an anionic surfactant, an amphoteric surfactant and a cationic surfactant can be used. Examples thereof are described in JP-A-62-73463 and JP-A-62-183457.

Further, in dispersing a substance capable of receiving a thermally immigrating dye, a releasing agent, an anti-fading agent, a UV absorber, a fluorescent whitening agent, and other hydrophobic compounds in a water-soluble binder, a surfactant is preferably used as a dispersion aid. For this purpose, the surfactants described in JP-A-59-157636 (pages 37 to 38) are particularly preferably used in addition to the above surfactants.

A matting agent can be used for the heat transfer dye-providing material and the heat transfer image-receiving material. Examples of the matting agent are the compounds described in JP-A-63-274944 and JP-A-63-274952, such as benzoguanamine resin beads, polycarbonate resin beads and styrene-acrylonitrile copolymer resin beads, in addition to the compounds described in JP-A-61-88256 (page 29), such as silicon dioxide, polyolefin and polymethacrylate.

As described above, the dye-providing material of the present invention is used in a process to form a transferred image. Such a process comprises the steps of heating imagewise the dye-providing material with a laser and transferring a dye image to the image-receiving material to form a transferred image, as described above.

The dye-providing material of the present invention is used in a sheet form, a continuous roll or a ribbon. Where it is used in a continuous roll or a ribbon, it contains only one kind of a dye or has separate areas containing different dyes, such as cyan and/or magenta and/or yellow and/or black and other dyes. That is, the materials of one color, two colors, three colors and four colors (or the materials of more colors) fall within the scope of the present invention.

In a preferable embodiment of the present invention, the dye-providing material comprises a support of polyethylene terephthalate having coated thereon layers containing a cyan dye, a magenta dye and a yellow dye in order; and the steps previously described are carried out one by one for each color to form a transferred image of three colors. In the embodiment carrying out this procedure in a single color, a monochromatic transferred image is obtained.

For the purpose of heat-transferring a dye from the dye-providing material to the image-receiving material, several kinds of lasers can be used, such as an ion gas laser including argon and krypton lasers, a metal vapor laser including copper, gold and cadmium lasers, a solid laser including ruby and YAG lasers, and a semiconductor laser including a gallium-arsenic laser emitting light in an infrared region of 750 to 870 nm. Of these lasers, the semiconductor laser is practicably favorable in terms of compactness, lower cost, stability, reliability, durability and ease in modulation. In order to have a laser useful for heating the dye-providing material, the laser light has to be absorbed in a layer containing an infrared-absorbing dye and converted to heat through a molecular process known as an inner conversion. For this purpose, a laser which emits a light having a wavelength to be absorbed by the infrared-absorbing dyes, preferably a wavelength of from about 750 nm to about 900 nm can be used. The laser which emits a light of the above wavelength is known as an infrared laser and, mainly can be selected from semiconductor lasers. Lasers capable of being used for transferring a dye from the dye-providing material of the present invention are commercially available.

The present invention is further described by the following examples, which should not be construed as limiting the present invention in any way. All parts, percents, ratios and the like are by weight unless otherwise indicated.

EXAMPLE 1

Inks for forming the dye-providing layers having the following compositions were coated on a 6 μm thick support of a polyester film manufactured by Teijin Co., Ltd. in the coated amount of 1.2 g/m$^2$ after drying, whereby the dye-providing material was obtained.

| Composition of the dye-providing layer-forming cyan ink | |
|---|---|
| Compound 2 (an infrared-absorbing dye) | 2.3 parts |
| Dye-a | 3 parts |

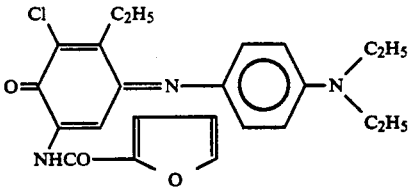

| | |
|---|---|
| Polyvinyl butyral resin (Denka Butyral 5000A, manufactured by Denki Chemical Co., Ltd.) | 2.5 parts |
| Polyisocyanate (Takenate D110N, manufactured by Takeda Industry Co., Ltd.) | 0.1 parts |
| Amino-modified silicone oil (KF-857, manufactured by Shin-Etsu Chemical Co., Ltd.) | 0.004 part |
| Methyl ethyl ketone | 50 parts |
| Toluene | 50 parts |

| Composition of the dye-providing layer-forming magenta ink | |
|---|---|
| Compound 1 (an infrared-absorbing dye) | 2.3 parts |
| Dye-b | 2.5 parts |

-continued

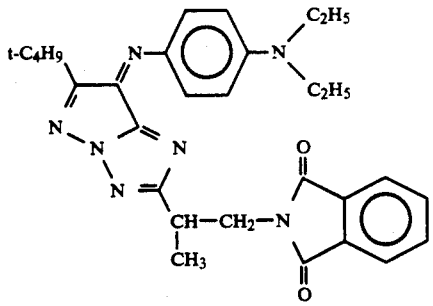

| | |
|---|---|
| Polyvinyl butyral resin (Eslex BX-1, manufactured by Sekisui Chemical Co., Ltd.) | 2.5 parts |
| Polyisocyanate (KP-90, manufactured by Dainippon Ink Chemical Co., Ltd.) | 0.1 part |
| Silicone oil (KF-857, manufactured by Shin-Etsu Chemical Co., Ltd.) | 0.004 part |
| Methyl ethyl ketone | 70 parts |
| Toluene | 30 parts |

Composition of the dye-providing layer-forming yellow ink

| | |
|---|---|
| Compound 4 (an infrared-absorbing dye) | 2.5 parts |
| Dye-c | 5 parts |

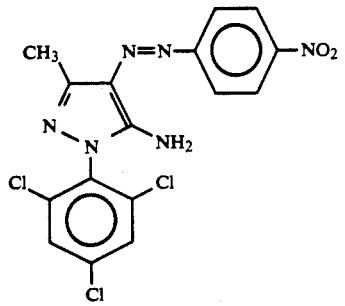

| | |
|---|---|
| Ethyl cellulose | 3 parts |
| Methyl ethyl ketone | 50 parts |
| Toluene | 50 parts |

Preparation of the heat transfer image-receiving material (1)

The image receiving layer-coating components of the following composition were applied on a support of 150 μm thick synthetic paper by a wire-bar coating method so that the dry thickness was 8 μm, whereby the heat transfer image-receiving material (1) was prepared.

After drying incompletely, the drying was carried out in an oven at 100° C. for 30 minutes.

| Image-receiving layer-coating components (1) | |
|---|---|
| Polyester resin (Vylon-200, manufactured by Toyobo Co., Ltd.) | 22 g |
| Polyisocyanate (KP-90, manufactured by Dainippon Ink Chemical Co., Ltd.) | 4 g |
| Amino-modified silicone oil (KF-857, manufactured by Shin-Etsu Chemical Co., Ltd.) | 0.5 g |
| Methyl ethyl ketone | 85 ml |
| Toluene | 85 ml |

The dye-providing material provided on a drum was superposed on the image-receiving material and was fixed with an adhesive tape. Then, this combined material was exposed to focused laser light having a wavelength of 830 nm, and the dye was transferred to the dye-receiving material. The laser light was emitted from a semiconductor laser device SDL-2420-H2 manufactured by Spectra Diode Lab Co., Ltd., in which the spot diameter and the irradiating time were 30 μm and 6 milliseconds, respectively, while the output was 85 mW.

The evaluation of the image formed on the image-receiving material is as follows.

The dye-providing material containing the compound of the present invention formed a clear color image on the image-receiving material, and no color stain from the infrared-absorbing dye was observed. The maximum reflection densities measured with a Macbeth densitometer were 2.2 for the red color of a cyan image, 2.3 for the green color of a magenta image and 2.4 for the blue color of a yellow image, indicating that the laser light was effectively absorbed by the infrared-absorbing dye and converted to heat.

EXAMPLE 2

The components for forming an infrared-absorbing layer having the following composition were coated on a polyethylene terephthalate support having a thickness of 25 μm so that the dry thickness of the coated layer became 1.5 μm, thereby forming the infrared-absorbing layer. The inks prepared by removing the infrared-absorbing dyes from the components for forming a dye-providing layer prepared in Example 1 were coated on this infrared-absorbing layer, whereby the dye-providing material of yellow, magenta and cyan was prepared.

| Ink composition for forming an infrared-absorbing layer | |
|---|---|
| Compound 5 (an infrared-absorbing dye) | 2.4 parts |
| Polyvinyl butyral resin (Denka Butyral 5000A, manufactured by Denki Chemical Co., Ltd.) | 2.5 parts |
| Methyl ethyl ketone | 70 parts |
| Toluene | 30 parts |

The dye-providing material thus obtained and the image-receiving material prepared in Example 1 were used to form a transferred image in the same manner as in Example 1. A laser diode SLD301 manufactured by Sony Corp. was used to emit the laser light.

The respective color images were sharp. The maximum reflection densities measured with a Macbeth densitometer were 1.9 for the red color of a cyan image, 2.1 for the green color of a magenta image and 2.1 for the blue color of a yellow image.

EXAMPLE 3

Preparation of the heat transfer image-receiving material (2)

Polyethylene was coated on both sides of a 200 μm thick paper in the thicknesses of 15 μm on one side and 25 μm on the other side to thereby prepare a resin-coated paper. The image-receiving layer-coating components (2) of the following composition were coated on the 15 μm thick polyethylene-coated side of the support with a wire-bar coating method so that the dry thickness thereof became 10 μm, followed by drying, whereby the heat transfer dye-receiving material (2) was prepared.

| Image-receiving layer-coating components (2) | |
|---|---|
| Polyester resin (TP-220, manufactured by Nippon Gosei Kagaku Co., Ltd.) | 25 g |
| Amino-modified silicone oil (KF-857, manufactured by Shin-Etsu Chemical Co., Ltd.) | 0.8 g |
| Polyisocyanate (KP-90, manufactured by Dainippon Ink Chemical Co., Ltd.) | 4 g |
| Methyl ethyl ketone | 100 ml |
| Toluene | 100 ml |

The image-receiving material thus obtained and the dye-providing material prepared in Example 1 were used to form a transferred image in the same manner as in Example 1. The obtained image was sharp and had a high density. The maximum reflection densities measured with a Macbeth densitometer were 2.1 for the red color of a cyan image, 2.3 for the green color of a magenta image and 2.1 for the blue color of a yellow image.

EXAMPLE 4

Preparation of the heat transfer image-receiving material (3)

A dye-receptive polymer (B) having the following composition was dispersed in an aqueous gelatin solution (A) of the following composition with a homogenizer, whereby a gelatin dispersion of a dye-receptive material was prepared.

| Aqueous gelatin solution (A) | |
|---|---|
| Gelatin | 2.3 g |
| Sodium dodecylbenzenesulfonate (5% aqueous solution) | 20 ml |
| Water | 80 ml |
| **Dye-receptive polymer solution (B)** | |
| Polyester resin (Vylon 300, manufactured by Toyobo Co., Ltd.) | 7.0 g |
| Carboxy-modified silicone oil (X-22-3710, manufactured by Shin-Etsu Chemical Co., Ltd.) | 0.7 g |
| Methyl ethyl ketone | 20 ml |
| Toluene | 10 ml |
| Triphenyl phosphate | 1.5 g |

The solution in which 0.5 g of a fluorinated surfactant $$C_3F_7SO_2\underset{\underset{C_3H_7}{|}}{N}CH_2COOK \qquad (a)$$

was dissolved in 10 ml of a mixed solvent of water and methanol (1:1 by volume) was added to the dispersion thus prepared to thereby prepare a coating composition for the image-receiving layer.

This coating composition was applied on a 150 μm thick synthetic paper (YUPO-SGG-150, manufactured by Ohji Petrochemical Co., Ltd.), the surface of which was subjected to a corona discharge, with a wire bar coating method so that the wet thickness thereof became 75 μm, followed by drying, whereby the heat transfer dye-receiving material (3) was prepared.

The obtained image-receiving material and the dye-providing material prepared in Example 2 were used to form a transferred image in the same manner as Example 2. The obtained image was sharp and had a high density. The maximum reflection densities measured with a Macbeth densitometer were 2.4 for the red color of a image, 2.1 for the green color of a magenta image and 2.2 for the blue color of a yellow image.

EXAMPLE 5

Dye-providing materials were prepared in the same manner as described in Example 1, except that the infrared-absorbing dyes and the cyan, magenta and yellow dyes used in the ink composition for dye-providing layers of Example 1 were replaced by the infrared-absorbing dyes and the dyes shown in Table 1 below. When the dyes of the resulting dye-providing material were transferred to the dye-receiving material in the same manner as described in Example 1, a clear color image having a high color density was obtained on the dye-receiving material. The maximum reflection densities measured with a Macbeth densitometer were shown in Table 1 below.

TABLE 1

| No. | Infrared-absorbing Dye | Dye | Maximum Reflection Density |
|---|---|---|---|
| 1 | Compound (10) | C-1 | 2.1 |
| 2 | Compound (41) | C-1 | 2.0 |
| 3 | Compound (63) | C-8 | 2.1 |
| 4 | Compound (72) | C-8 | 1.9 |
| 5 | Compound (16) | M-8 | 2.2 |
| 6 | Compound (37) | M-8 | 2.3 |
| 7 | Compound (51) | M-10 | 2.0 |
| 8 | Compound (67) | M-10 | 2.1 |
| 9 | Compound (22) | Y-5 | 2.3 |
| 10 | Compound (30) | Y-5 | 2.1 |
| 11 | Compound (61) | Y-10 | 2.2 |
| 12 | Compound (69) | Y-10 | 2.3 |

COMPARATIVE EXAMPLE

A dye-providing material was prepared in the same manner as described in Example 1, except that the infrared absorbing-dyes used in the ink compositions for dye-providing layers of Example 1 were replaced by carbon black. When the dyes of the resulting dye-providing material were transferred to the dye-receiving material in the same manner as described in Example 1, the maximum reflection densities measured with a Macbeth densitometer were 1.5 for the red color of a cyan image, 1.7 for the green color of a magenta image and 1.8 for the blue color of a yellow image.

Also, particles of carbon black were adhered to the dye-receiving material and the stain of the image was observed.

While the invention has been described in detail and with reference to specific embodiments thereof, it will be apparent to one skilled in the art that various changes and modifications can be made therein without departing from the spirit and scope thereof.

What is claimed is:

1. A thermal transfer dye-providing material comprising a support having provided thereon a layer containing a thermally migrating dye, wherein at least one of the dye-containing layer and a layer adjacent thereto contains an infrared-absorbing dye represented by Formula (I):

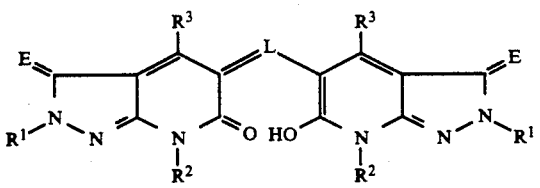

(I)

wherein L represents a substituted or unsubstituted methine group, trimethine chain or pentamethine chain, which is formed by linking the methine groups with a conjugated double bond; E represents O, S or N—$R^4$; $R^1$ and $R^4$ can be substituted or unsubstituted and independently represent an alkyl group, an alkenyl group, an alkynyl group, an aryl group, a heterocyclic group, an amino group, a hydrazino group, or a diazenyl group, provided that $R^1$ and $R^4$ may be combined to form a ring; $R^2$ can be substituted or unsubstituted and represents a hydrogen atom, an alkyl group, an aryl group, an alkenyl group, an alkynyl group, or a heterocyclic group; and $R^3$ can be substituted or unsubstituted and represents a hydrogen atom, a halogen atom, a cyano atom, a nitro group, a hydroxy group, a carboxyl group or a salt thereof, an alkyl group, an aryl group, an alkenyl group, a heterocyclic group, an alkoxy group, an aryloxy group, an alkoxycarbonyl group, an aryloxycarbonyl group, an amino group, an acyloxy group, a carbamoyl group, a sulfamoyl group, an alkylthio group, an arylthio group, an alkylsulfonyl group, an arylsulfonyl group, or an alkynyl group.

2. A thermal transfer dye-providing material as in claim 1, wherein L represents Formula (a):

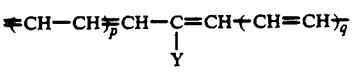

(a)

wherein Y represents a hydrogen atom or a monovalent group, and p and q independently represent 0 or 1.

3. A thermal transfer dye-providing material as in claim 2, wherein Y is a hydrogen atom and at least one of p and q is 0.

4. A thermal transfer dye-providing material as in claim 1, wherein L represents Formula (b):

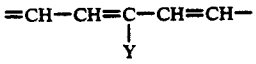

(b)

wherein Y represents a hydrogen atom or a monovalent group.

5. A thermal transfer dye-providing material as in claim 4, wherein Y is a hydrogen atom.

6. A thermal transfer dye-providing material as in claim 1, wherein E represents 0 or N—$R^4$, where $R^4$ represents an alkyl group, an alkenyl group, an aryl group, an amino group, a hydrazino group, or a diazenyl group.

7. A thermal transfer dye-providing material as wherein E represents N-R4, and R4 is combined with $R^1$ to form a ring.

8. A thermal transfer dye-providing material as in claim 7, wherein the ring is selected from the group consisting of an imidazole ring, a pyrazole ring, a triazole ring, and a tetrazole ring.

9. A thermal transfer dye-providing material as in claim 1, wherein $R^1$ represents an alkyl group having 1 to 30 carbon atoms, a phenyl group having 6 to 30 carbon atoms, or a 5- or 6-membered heterocyclic group having 1 to 30 carbon atoms.

10. A thermal transfer dye-providing material as in claim 9, wherein $R^1$ represents an alkyl group having 1 to 20 carbon atoms, a phenyl group having 6 to 20 carbon atoms, or a 5- or 6-membered heterocyclic group having 1 to 20 carbon atoms.

11. A thermal transfer dye-providing material as in claim 1, wherein $R^2$ represents a hydrogen atom, an alkyl group having 1 to 30 carbon atoms, a phenyl group having 6 to 30 carbon atoms, or a 5- or 6-membered heterocyclic group having 1 to 30 carbon atoms.

12. A thermal transfer dye-providing material as in claim 11, wherein $R^2$ represents a hydrogen atom, an alkyl group having 1 to 20 carbon atoms, a phenyl group having 6 to 20 carbon atoms, or a 5- or 6-membered heterocyclic group having 1 to 20 carbon atoms.

13. A thermal transfer dye-providing material as in claim 1, wherein $R^3$ represents a hydrogen atom, an alkyl group having 1 to 30 carbon atoms, a phenyl group having 6 to 30 carbon atoms, a carbamoyl group having 1 to 30 carbon atoms, an alkoxycarbonyl group having 2 to 30 carbon atoms, a phenoxycarbonyl group having 7 to 30 carbon atoms, a carboxyl group and a salt thereof, or a hydroxy group.

14. A thermal transfer dye-providing material as in claim 13, wherein $R^3$ represents an alkyl group having 1 to 20 carbon atoms, a phenyl group having 6 to 20 carbon atoms, a carbamoyl group having 1 to 20 carbon atoms, an alkoxycarbonyl group having 2 to 20 carbon atoms, a phenoxycarbonyl group having 7 to 20 carbon atoms, a carboxyl group and a salt thereof, or a hydroxy group.

* * * * *